United States Patent [19]

Derry

[11] Patent Number: 4,915,657

[45] Date of Patent: Apr. 10, 1990

[54] METHOD AND APPARATUS FOR MICROMINIATURIZED HEADER ASSEMBLY

[75] Inventor: Robert W. Derry, Stacy, Minn.

[73] Assignee: Honeywell Inc., Minneapolis, Minn.

[21] Appl. No.: 325,452

[22] Filed: Mar. 17, 1989

[51] Int. Cl.[4] ..... H01R 11/05

[52] U.S. Cl. ..... 439/879; 29/882; 439/936

[58] Field of Search ..... 29/841, 842, 861, 863, 29/876, 882; 439/879, 880, 651, 653, 936

[56] References Cited

U.S. PATENT DOCUMENTS 4,253,234 3/1981 Niles et al. ..... 29/876 X

OTHER PUBLICATIONS

Brochure, *TRW Worldwide Connectors*, ".050" Density Solder Cup/Wire D-Microminiature connector", p. 309, TRW, Inc.

*Primary Examiner*—Eugene F. Desmond

*Attorney, Agent, or Firm*—Kinney & Lange

[57] ABSTRACT

A header assembly for use in making electrical contact through the wall or bulkhead of a device such as a laser gyro which utilizes standard available components and is constructed in accordance with standard available procedures so as to effectuate a lower cost-effective header.

10 Claims, 2 Drawing Sheets

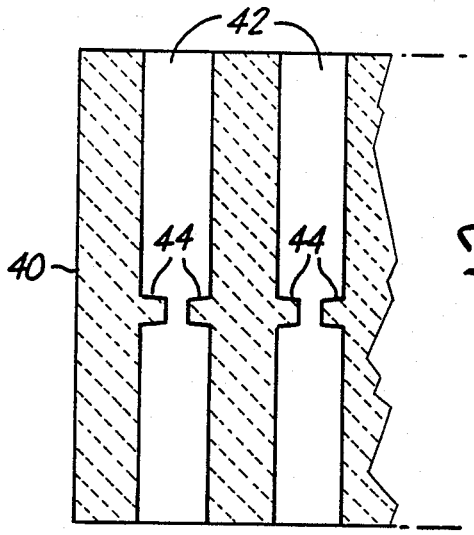
Fig. 6
Fig. 7
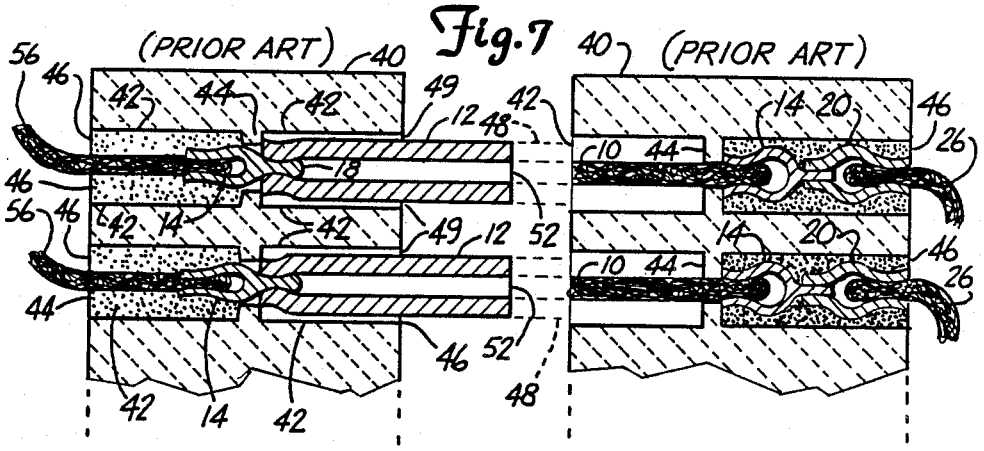
Fig. 8
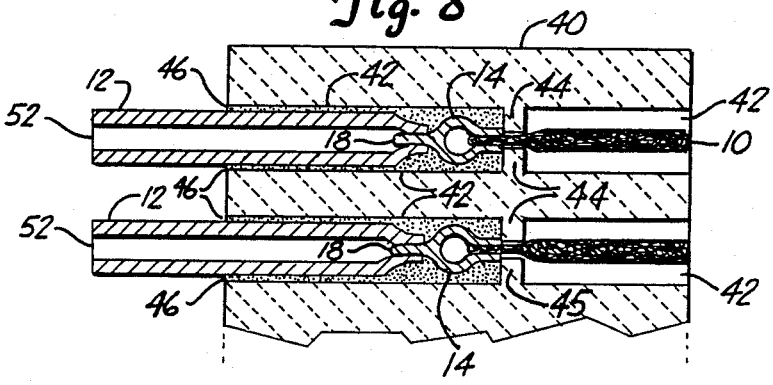

METHOD AND APPARATUS FOR MICROMINIATURIZED HEADER ASSEMBLY

BACKGROUND OF THE INVENTION

1. Field of the Invention

The present invention relates to microminiaturized header assemblies for conducting signals through a wall or bulkhead and operable on either or both sides to be connected to standard microminiaturized mating connectors.

2. Description of the Prior Art

Microminiaturized connectors are well known in the art. For example, TRW produces a 0.050 inch density solder cup/wire D-Microminiature connector operable to connect a plurality of wires in a cable to another plurality of wires connected to a connector with the two connectors being matable.

In order to bring a first plurality of wires through a wall or bulkhead in a "header" assembly, it has heretofore been necessary to specifically design a header for each application. Such header design is time consuming and costly since it does not make use of standard available parts and simple known processes in the construction thereof.

SUMMARY OF THE INVENTION

The present invention is intended to provide a header assembly utilizing the standard commercially available parts used in the production of a connector and constructed with processes similar to those used in creating the connector. The term "header" as used herein means a device for mounting in a wall or bulkhead and to which, connectors may be connected on either side there of the allow conduction of electrical signals. The header on one side will be matable to a connector that can be in turn connected to a first plurality of wires in a cable and on the other side matable to a second connector which itself is connected to a plurality of wires in a cable. The bulkhead or wall may be, for example, the casing of a laser gyro and the header is operable to conduct signals to and from the gyro through the casing in a simple, low cost and accurate fashion.

The present invention accomplishes this by producing a header assembly from the same parts that are used to make a connector assembly but in such a way that both sides of the header assembly are matable with the connector assemblies rather than having to be soldered or otherwise directly fastened to the wires in the cables leading to and from the gyro.

BRIEF DESCRIPTION OF THE DRAWINGS

FIG. 6 shows a standard plastic insulating housing for mounting male and female connector members;

FIG. 7 shows on the right hand side thereof a male connector member constructed with the apparatus and processes of FIGS. 1–6, and on the left side thereof shows a female connector member constructed with similar apparatus and processes; and FIG. 8 shows a header assembly made in accordance with the teachings of the present invention.

DETAILED DESCRIPTION OF THE PREFERRED EMBODIMENT

FIGS. 1–7 illustrate apparatus and methods for constructing microminiature connector assemblies such as those produced by TRW and identified as the 0.050 inch density solder cup/wire D-Microminiature connector.

Figure 1:
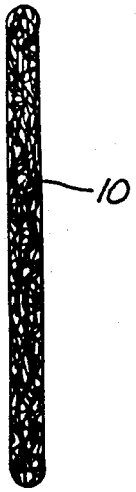
FIG. 1 shows a standard male connection member composed of a plurality of braided wires or possibly solid wire.

In FIG. 1, a male connection member 10 is shown which may be solid or may be formed by a plurality of wires woven in such a fashion as to be structurally strong enough to be insertable into a female connection member such as that shown in FIG. 7 as connector 12.

Figure 2:
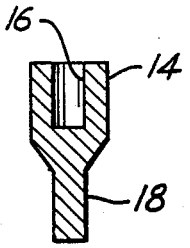
FIG. 2 shows a standard "Y" joining member used in making connectors.

FIG. 2 shows a "Y" shaped connection member 14 having a cup-shaped interior 16 of size suitable to receive the male connection member 10 of FIG. 1 and having a downwardly extending protrusion 18.

Figure 3:
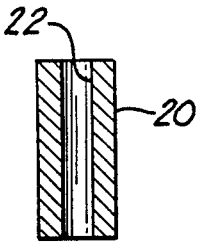
FIG. 3 shows a standard tubular connecting member used in making connectors.

FIG. 3 shows a short hollow connection member 20 having an interior bore 22 of diameter sufficient to receive the downwardly extending member 18 of connector element 14.

Figure 4:
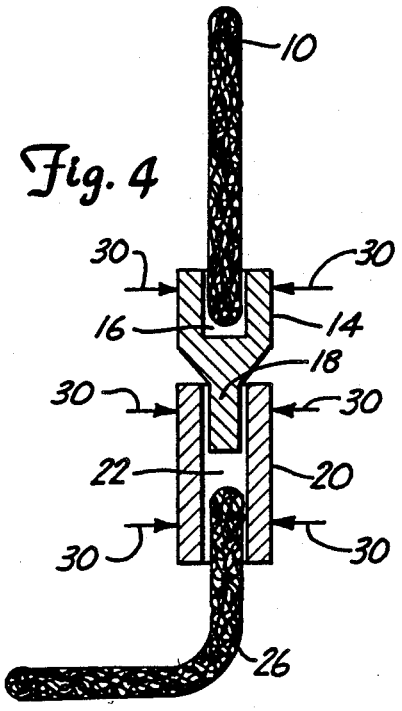
FIG. 4 shows schematically the first step of a process for making a male connector member utilizing the standard components of FIGS. 1–3.

FIG. 4 shows the male connector member 10 inserted into the cup-shaped portion 16 of "Y" shaped member 14. The downwardly extending member 18 of "Y" shaped member 14 is shown inserted into the upper portion of bore 22 of connector member 20. A wire 26, which may be one of a plurality of wires from a cable, is shown inserted into the lower portion of bore 22 and extending outwardly therefrom. In FIG. 4, a plurality of arrows 30 are shown representing points at which compression force is to be applied for purposes of solidly binding the male connector member 10 into the U-shaped cup 16, the downwardly extending member 18 into the upper portion of bore 22 and the wire 26 into the lower portion of bore 22.

Figure 5:
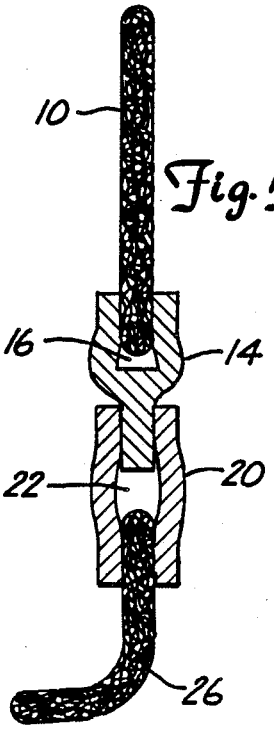
FIG. 5 shows a second step in the process of making a male connection member utilizing the standard apparatus of FIGS. 1–3.

FIG. 5 shows the assembly after the compression forces have been applied to the points represented by arrows 30 in FIG. 4. It can be seen that the "Y" shaped member 14 is distorted on the upper portion thereof so as to firmly connect to the male connection member 10. The tubular member 20 is shown distorted inwardly at the upper and lower portions so as to bind the downwardly extending member 18 of "Y" shaped member 14 and the upwardly extending wire 26 in firm, mechanically strong and conductive electrical contact.

FIG. 6 shows a portion of a connector housing 40 formed so as to provide a plurality of passages 42 therethrough. Each passage is formed with an inwardly extending abutment 44 near the central portion thereof for purposes to be explained hereinafter. The housing 40 is made of insulating material, preferably plastic, and is of standard shape such as used by TRW in the manufacture of their 0.050 inch density solder cup/wire D-Microminiature connector.

On the right side of FIG. 7, the housing 40 is shown having the connector assembly of FIG. 5 inserted therein. It is seen that the top edge of the "Y" shaped member 14 in FIG. 2 presses against the abutment 44 so that the male connector member 10 extends through the central portion thereof into the left-hand side of the aperture 42 in housing 40. The right-hand side of aperture 42 contains the "Y" shaped member 14 and the short tube member 20 with wire 26 extending therefrom, and this aperture is subsequently filled with a plastic bonding material such as epoxy 46. The aperture 42 remains unfilled so as to permit the ingress of the female connector 12 for purposes of connecting two connector assemblies together as shown by dashed lines 48 in FIG. 7.

The left-hand portion of FIG. 7 includes the female connector member 12 assembled into a second housing assembly member 40 which may be identical with member 40 of FIG. 6. The centralized abutment 44 cooperates with the left end of female connector 12 and the space between female member 12 and the interior of the apertures 42 may be back filled with an epoxy 46 in a manner similar to the right-hand side of FIG. 7.

Female member 12 has a central bore 52 sized so as to make good electrical contact with the male member 10 when assembled. The left end of female member 12 is shown distorted so as to solidly grasp the extension member 18 of a second "Y" shaped member 14 to make good electrical contact therewith.

The other end of the second "Y" shaped member 14 is shown distorted so as to grasp the end of a wire 56 which may be part of a cable connection connected to connector 40. The space remaining in the left-hand side of aperture 42 may also be back filled with an epoxy bonding material 46 so as to make a firm, rigid and insulating connection for the connector.

It is thus seen that the standard procedure for making male and female connectors such as the TRW 0.050 inch density solder cup/wire D-Microminiature connectors is a fairly simple, straightforward procedure.

The procedures thus far described in making the connector assemblies have, heretofore, been inapplicable to making a header which extends through the wall or bulkhead of a device and, in the prior art, specialized headers were constructed so as to be suitably sized to mate with either the female or male connector assemblies already existing. The processes for specifically designing each header is time consuming and expensive.

The present invention shown in FIG. 8 utilizes the same apparatus as is available in the making of the connectors of FIG. 7 and the same processes are involved so as to produce a header assembly which is inexpensive in construction and utilizes standard procedures.

In FIG. 8, the standard housing assembly 40, having the usual internal apertures 42 and the centralized abutment 44, is shown. The "Y" shaped connector !4 is shown, as in FIG. 5, deformed at its right-hand side so as to firmly grasp the end of the male connector member 10. In FIG. 8, rather than using the connector member 20 of FIG. 3, the female member 12 with its central aperture 52 is shown extending into the left-hand of opening 42 and being distorted on its right-hand end so as to firmly grasp the abutment portion 18 of "Y" shaped member 14. After assembly into housing 40, the left-hand portion of aperture 42 may be back filled with an epoxy 46 in a fashion similar to that shown in FIG. 7.

With the apparatus of FIG. 8, a bulkhead header assembly is created having a male attachment member 10 on the right-hand end and a female attachment member 12 on the left-hand end. This header assembly may be mounted in the wall or bulkhead of a device such as a laser gyro and thereafter be immediately connectable to the standard connectors already available such as those sold by TRW and described above in FIG. 7.

It is therefore seen that I have provided a header assembly which may be constructed utilizing already existing components and procedures which are available in the prior art for making connectors.

Although the present invention has been described with reference to preferred embodiments, workers skilled in the art will recognize that changes may be made in form and detail without departing from the spirit and scope of the invention.

What is claimed is:

1. The method of making an electrical header assembly consisting of a housing having an aperture, a male connector, a "Y" shaped connector, and a female connector obtained from standard components normally used in connector assemblies comprising the steps of:

A. pinching one end of the male connector in the "Y" shaped connector;

B. pinching the other end of the "Y" shaped connector in one end of the female connector; and C. inserting the resulting male, "Y" shaped and female connectors in the aperture to form a header assembly.

2. The method of claim 1 including the further step of:

D. back filling the aperture surrounding the female connector with an insulating bonding material.

3. The method of claim 1 wherein the aperture has an abutment portion of reduced diameter and in step C the male connector is on one side of the abutment portion and the "Y" shaped and female connector is on the other side of the abutment.

4. The method of claim 3 including the further step of:

E. back filling the aperture on said other side of the abutment with an insulating bonding material.

5. An electrical header assembly comprising:

a standard housing normally used in connectors having an aperture therethrough;

a standard male connector member normally used in connectors mounted in the aperture;

a standard "Y" shaped member normally used in connectors mounted in the aperture and having a cup shaped portion and a tail portion, the cup shaped portion being crimped to make good electrical contact with one end of the male connector member; and a standard female connector member normally used in connectors mounted in the aperture and having an initial bore sized to fit a standard male connector, one end of the female connector member crimped to the tail portion of the "Y" shaped member to make good electrical contact.

6. Apparatus according to claim 5 wherein the aperture adjacent the female connector member is back filled with an insulating bonding material.

7. Apparatus according to claim 5 wherein the aperture has an abutment portion of reduced diameter intermediate the ends thereof and the male connector member is in the aperture on one side of the abutment portion and the "Y" and female connector members are in the aperture on the other side of the abutment.

8. Apparatus according to claim 7 wherein the aperture on the said other side of the abutment is back filled with an insulating bonding material.

9. An electrical header assembly comprising:

an electrically insulating housing having a plurality of apertures therethrough each with each aperture having a generally centralized abutment portion of reduced diameter therein;

a plurality of male connector members positioned with one in each of the apertures with one end extending through the reduced diameter and the other end extending on a first side of the abutment portion;

a plurality of "Y" shaped members each mounted in the aperture on a second side of the abutment and having a cup shaped portion and a tail portion, one of each of the cup shaped portions crimped to make good electrical contact with a separate end of, each male connector member which extends through the reduced diameter; and a plurality of female connector members each having a central bore positioned with one in each of the apertures on the second side of the abutment, the tail portion of each "Y" shaped member extending into one end of the bore of each female connector member and being crimped there in good electrical contact.

10. Apparatus according to claim 9 wherein the second side of the abutment is back filled with an insulating bonding material.

* * * * *

UNITED STATES PATENT AND TRADEMARK OFFICE

CERTIFICATE OF CORRECTION

PATENT NO. : 4,915,657

DATED : April 10, 1990

INVENTOR(S) : Robert W. Derry

It is certified that error appears in the above-identified patent and that said Letters Patent is hereby corrected as shown below:

Column 5, line 10, delete "of, each" and insert --of each--.

Signed and Sealed this

Eighteenth Day of June, 1991

*Attest:*

HARRY F. MANBECK, JR.

*Attesting Officer*

*Commissioner of Patents and Trademarks*